US009770143B2

(12) United States Patent
Corley et al.

(10) Patent No.: US 9,770,143 B2
(45) Date of Patent: Sep. 26, 2017

(54) ELECTRONIC ROLL TOWEL DISPENSER

(75) Inventors: Lockland Corley, Coquitlam (CA); Andrew Jackman, Langley (CA); Alex Trampolski, Richmond (CA); Richard Ybo Lalau, North Vancouver (CA); Damir Wallener, Duncan (CA)

(73) Assignee: DISPENSING DYNAMICS INTERNATIONAL LTD., Surrey (CA)

( * ) Notice: Subject to any disclaimer, the term of this patent is extended or adjusted under 35 U.S.C. 154(b) by 713 days.

(21) Appl. No.: 14/128,506

(22) PCT Filed: Jun. 21, 2011

(86) PCT No.: PCT/CA2011/000733

§ 371 (c)(1),
(2), (4) Date: May 23, 2014

(87) PCT Pub. No.: WO2014/174630

PCT Pub. Date: Dec. 27, 2012

(65) Prior Publication Data

US 2014/0291437 A1 Oct. 2, 2014

(51) Int. Cl.
*A47K 10/38* (2006.01)
*A47K 10/36* (2006.01)

(52) U.S. Cl.
CPC ..... *A47K 10/38* (2013.01); *A47K 10/36* (2013.01); *A47K 10/3625* (2013.01); *A47K 2010/3668* (2013.01)

(58) Field of Classification Search
CPC ..... A47K 10/36
See application file for complete search history.

(56) References Cited

U.S. PATENT DOCUMENTS 6,069,354 A * 5/2000 Alfano ..... A47K 10/36 242/563
6,412,655 B1 7/2002 Stuetzel et al.
6,695,246 B1 * 2/2004 Elliott ..... A47K 10/36 242/563
6,940,291 B1 * 9/2005 Ozick ..... G01D 5/2405 324/658

(Continued)

FOREIGN PATENT DOCUMENTS

EP 0 330 553 A1 8/1989

*Primary Examiner* — Gene Crawford
*Assistant Examiner* — Stephen Akridge
(74) *Attorney, Agent, or Firm* — Seed Intellectual Property Law Group LLP

(57) ABSTRACT

This disclosure relates to a dispenser which in one embodiment is a motorized electric dispenser that reliably detects a request for a portion of product and electromechanically dispenses a pre-determined length of product to the user, without the user needing to directly touch any part of the dispenser. The dispenser comprises a product path passing between an engagement opening and a capacitive sensor. A controller is operatively configured to identify a dispense request based upon a detection signal received from the capacitive sensor and activate a drive motor upon the identification of the dispense request. The dispense request is defined as an introduction of a user target within an introduction threshold distance from the capacitive sensor followed by a removal of the user target beyond a removal threshold distance away from the capacitive sensor.

18 Claims, 12 Drawing Sheets

(56) References Cited

U.S. PATENT DOCUMENTS

| | | | | |
|---|---|---|---|---|
| 6,977,588 | B2 * | 12/2005 | Schotz | A47K 10/36 242/570 |
| 7,398,944 | B2 * | 7/2008 | Lewis | A47K 10/36 242/563 |
| 2003/0167893 | A1 * | 9/2003 | Morris | A47K 10/36 83/649 |
| 2004/0134924 | A1 * | 7/2004 | Hansen | A47K 10/36 221/9 |
| 2004/0173440 | A1 | 9/2004 | Mauch et al. | |
| 2006/0173576 | A1 * | 8/2006 | Goerg | A47K 10/3845 700/236 |
| 2006/0267953 | A1 | 11/2006 | Peterson, Jr. et al. | |
| 2007/0079684 | A1 * | 4/2007 | Friesen | B26D 1/42 83/649 |
| 2008/0061800 | A1 | 3/2008 | Reynolds et al. | |
| 2009/0217870 | A1 * | 9/2009 | Luu | A47K 10/32 118/419 |
| 2010/0176237 | A1 * | 7/2010 | Friesen | A47K 10/3637 242/563.2 |
| 2010/0243696 | A1 * | 9/2010 | Friesen | A47K 10/36 225/10 |
| 2011/0114782 | A1 * | 5/2011 | Rodrian | A47K 10/36 242/563 |
| 2011/0133010 | A1 * | 6/2011 | Pelland | A47K 10/16 242/160.4 |
| 2011/0215188 | A1 * | 9/2011 | Lalau | A47K 10/36 242/564.1 |
| 2011/0215820 | A1 * | 9/2011 | Lalau | G01D 5/2405 324/686 |
| 2012/0109366 | A1 * | 5/2012 | Lowery | A47K 10/36 700/231 |
| 2015/0238056 | A1 * | 8/2015 | Fellhoelter | A47K 10/3687 242/560 |

* cited by examiner

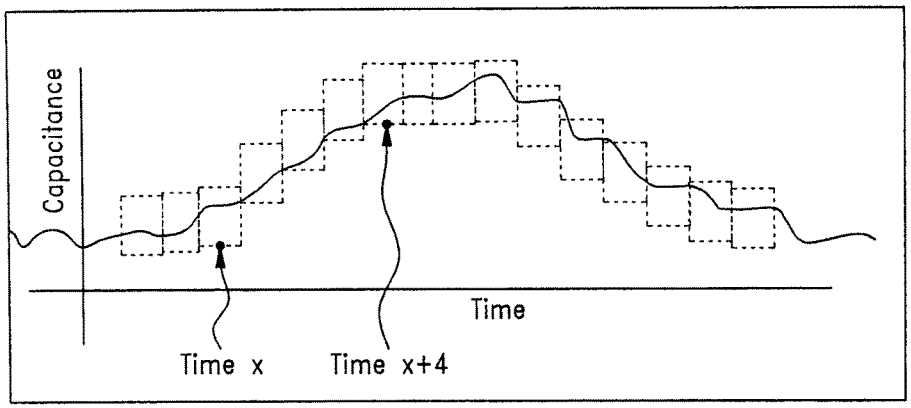
*Fig. 14*
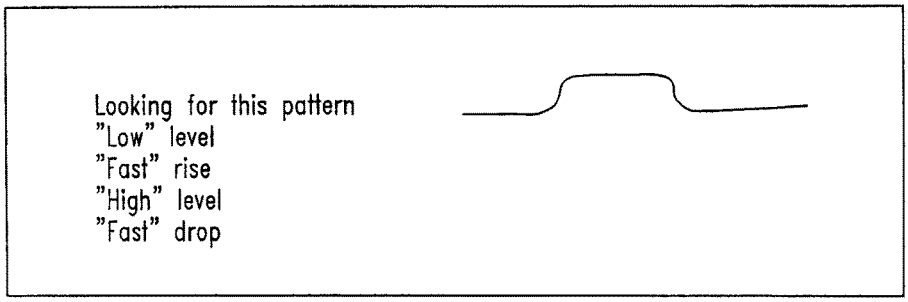
*Fig. 15*
| | | | | | | | | | | | | | | | | | | | | | | | | |
|---|---|---|---|---|---|---|---|---|---|---|---|---|---|---|---|---|---|---|---|---|---|---|---|---|
| "X" | "X" | "X" | "X" | "X" | "X" | "X" | > | > | > | > | > | -2/ | -2/ | -2/ | -2/ | < | < | < | < | < | "X" | "X" | "X" |
| | | | | | | | +5 | +5 | +5 | +5 | +5 | +2 | +2 | +2 | +2 | -5 | -5 | -5 | -5 | -5 | | | |
*Fig. 16*
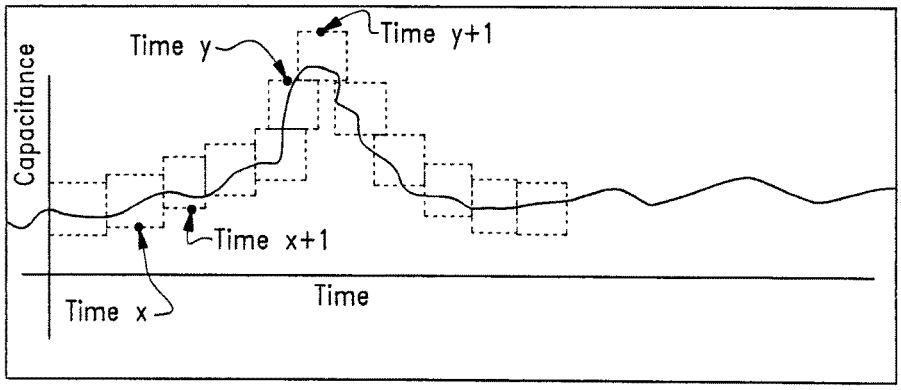
*Fig. 17*

ELECTRONIC ROLL TOWEL DISPENSER

FIELD

The present disclosure generally relates to electronic roll towel dispensers.

BACKGROUND OF THE DISCLOSURE

Prior art dispensers, such as paper towel dispensers, toilet paper dispensers, and other dispensers for paper products distributed on rolls, generally fall into two categories: touchless sensor-type dispensers, wherein a user typically is required to wave their hand in front of a proximity sensor to initiate a motorized dispensing cycle of a portion of the desired product; and pushbutton or manual advance dispensers, wherein a user must contact a surface of the dispenser, either to push a button or to advance a manual assembly, to receive a portion of the desired product. These dispensers have faced substantial difficulties. For example, with the common "touchless" sensor-type dispensers, the sensor has proven to be relatively problematic in its responsiveness to different individuals and its performance in noisy environments. Furthermore, as the sensor is usually positioned on or behind the casing of the dispenser, often users will still come in contact with the portion of the casing or the sensor space when initiating a dispensing cycle. Thus, germs and diseases can be transmitted from person to person. For the pushbutton or manual dispensers, the user must come into contact with the dispenser to activate or utilize the dispenser, and thus germs are even more likely to be transmitted from person to person.

SUMMARY OF THE DISCLOSURE

This disclosure relates to a dispenser which in one embodiment is a motorized electric dispenser that reliably detects a request for a portion of product and electromechanically dispenses a length of product to the user, without the user needing to directly touch any part of the dispenser.

In one aspect of the present disclosure, there is provided a hygienic product dispenser for dispensing a length of product from a product roll, the dispenser comprising:

a. a dispenser housing comprising a dispensing slot and an engagement opening;
b. a drive roller operatively configured to engage the product being dispensed;
c. a drive motor coupled to the drive roller;
d. a capacitive sensor adjacent to the engagement opening and operatively configured to provide a detection signal representing the proximity of a user target from the capacitive sensor;
e. a product path defined as the path the product will take from the product roll to the dispensing slot, the product path passing between the engagement opening and the capacitive sensor; and
f. a controller in communication with the capacitive sensor and the drive motor, the controller operatively configured to identify a dispense request based upon the detection signal received from the capacitive sensor and activate the drive motor upon the identification of the dispense request, the dispense request defined as an introduction of the user target within an introduction threshold distance from the capacitive sensor followed by a removal of the user target beyond a removal threshold distance away from the capacitive sensor.

The dispense request may be identified based upon a comparison of the detection signal received from the capacitive sensor to a dispense request profile, the dispense request profile defining one or more characteristics indicative of the introduction of the user target within the introduction threshold distance from the capacitive sensor followed by the removal of the user target beyond the removal threshold distance away from the capacitive sensor.

The comparison of the detection signal received from the capacitive sensor to the dispense request profile may comprise:

a. establishing a plurality of time period based dispense request counting windows, each dispense request counting window encompassing a selected portion of the detection signal differing from selected portions of the detection signal encompassed by other dispense request counting windows;
b. calculating delta values between selected dispense request counting windows to provide an array of delta values; and
c. comparing the dispense request profile to the array of delta values.

The dispense request profile may approximate a positive square wave pulse representing the introduction of the user target within the introduction threshold distance to the capacitive sensor followed by a negative square wave pulse representing the removal of the user target beyond the removal threshold distance away from the capacitive sensor.

The dispense request may be defined as the introduction of the user target in contact with a portion of the product passing between the engagement opening and the capacitive sensor followed by the removal of the user target from contact with that portion of the product.

The controller may be further operatively configured to:

a. identify a stop request based upon the state of the drive motor and the detection signal received from the capacitive sensor; and
b. deactivate the drive motor upon the identification of the stop request, the stop request defined as an introduction of the user target within a stop threshold distance from the capacitive sensor while the driver motor is activated.

The stop request may be identified based upon a comparison of the detection signal received from the capacitive sensor to a stop request profile, the stop request profile defining one or more characteristics indicative of the introduction of the user target within the stop threshold distance from the capacitive sensor.

The comparison of the detection signal received from the capacitive sensor to the stop request profile may comprise:

a. establishing a plurality of time period based stop request counting windows, each stop request counting window encompassing a selected portion of the detection signal differing from selected portions of the detection signal encompassed by other stop request counting windows;
b. calculating delta values between selected stop request counting windows to provide an array of delta values; and
c. comparing the stop request profile to the array of delta values.

The stop request profile may approximate a positive square wave pulse representing the introduction of the user target within the stop threshold distance from the capacitive sensor.

The product dispenser may be further configured such that:

a. the drive roller further comprises one or more drum targets;

b. the capacitive sensor comprises a single antenna adjacent to both the engagement opening and the drive roller; and c. the capacitive sensor is further operatively configured to provide a detection signal indicative of the proximity of the user target and the one or more drum targets to the capacitive sensor; and d. the controller is further operatively configured to identify and distinguish dispense requests and drum target events based upon the detection signal received from the capacitive sensor, the drum target events defined as the presence of the one or more drum targets at one or more drum threshold distances from the capacitive sensor.

The product dispenser may be further configured such that:

a. the dispense request is identified based upon a comparison of the detection signal received from the capacitive sensor to a dispense request profile, the dispense request profile defining one or more characteristics indicative of the introduction of the user target within the introduction threshold distance from the capacitive sensor followed by the removal of the user target beyond the removal threshold distance away from the capacitive sensor; and b. the drum event is identified based upon a comparison of the detection signal received from the capacitive sensor to a drum event profile, the drum event profile defining one or more characteristics indicative of the presence of the one or more drum targets at one more drum threshold distances from the capacitive sensor.

The product dispenser may be further configured such that:

a. the comparison of the detection signal received from the capacitive sensor to the dispense request profile comprises:

i. establishing a plurality of time period based dispense request counting windows, each dispense request counting window encompassing a selected portion of the detection signal differing from selected portions of the detection signal encompassed by other dispense request counting windows;

ii. calculating delta values between selected dispense request counting windows to provide an array of delta values; and iii. comparing the dispense request profile to the array of delta values; and b. the comparison of the detection signal received from the capacitive sensor to the drum event profile comprises:

i. establishing a plurality of time period based drum event counting windows, each drum event counting window encompassing a selected portion of the detection signal differing from selected portions of the detection signal encompassed by other drum event counting windows;

ii. calculating delta values between selected drum event counting windows to provide an array of delta values; and iii. comparing the drum event profile to the array of delta values.

The product dispenser may be further configured such that:

a. the dispense request profile approximates a positive square wave pulse representing the introduction of the user target within the introduction threshold distance to the capacitive sensor followed by a negative square wave pulse representing the removal of the user target beyond the removal threshold distance away from the capacitive sensor; and b. the drum event profile comprises periodic alternating minimum and maximum values of the array of delta values.

BRIEF DESCRIPTION OF THE DRAWINGS

FIGS. 13 and 14 are diagrammatic illustrations relating to a delta method according to one embodiment.

FIG. 15 is a representation of an exemplary pattern searched by the algorithm of the delta method.

FIG. 16 illustrates the pattern of FIG. 15 in a linear representation.

FIG. 17 is a diagrammatic illustration showing the principles of operation of a multi-sample delta method in accordance with one embodiment.

DESCRIPTION OF EMBODIMENTS

This disclosure relates to a dispenser which in one embodiment is a motorized electric dispenser that reliably detects a request for a portion of product and electromechanically dispenses a pre-determined adjustable length of product to the user, without the user needing to directly touch any part of the dispenser.

Figure 1:
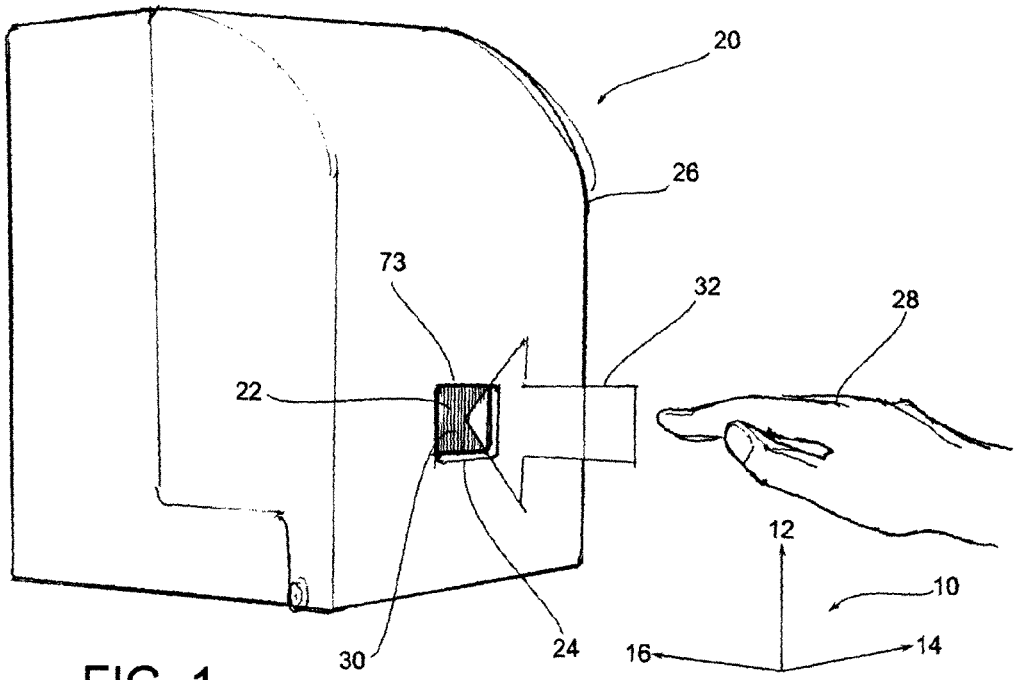
FIG. 1 is a schematic view of a hygienic dispenser according to one embodiment.
Figure 2:
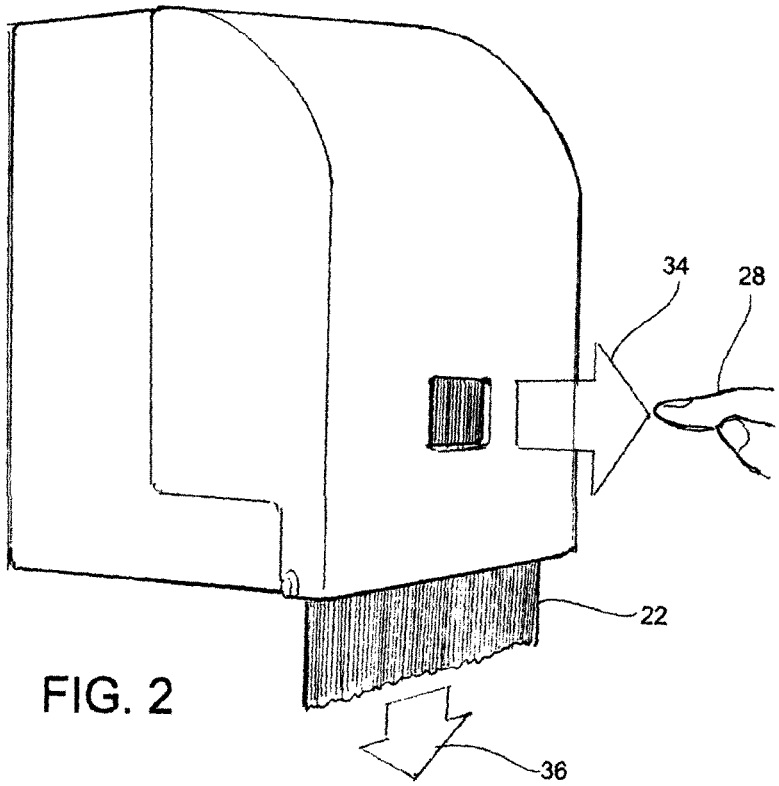
FIG. 2 is a schematic view of a hygienic dispenser shown in FIG. 1 in use in one embodiment.

Referring to FIG. 1, the dispenser 20 is shown, wherein a portion of the product 22 to be dispensed is exposed through an engagement opening 24 in the front casing 26 of the dispenser 20. It can be seen that a user target 28 is reaching towards an exposed portion 30 of the product 22 in a direction of travel 32. Behind the exposed portion 30 is a capacitive sensor 68 (shown in FIGS. 3 and 4) which is configured to provide a detection signal indicative of the proximity of the user target 28 to the capacitive sensor 68. Referring to FIG. 2, as the user target 28 is withdrawn away from the capacitive sensor 68 in a direction of travel 34, a portion of the product 22 is dispensed out of the bottom of the dispenser 20 in a direction of travel 36.

Before beginning a detailed description of the dispenser 20, an axes system 10 is shown in FIG. 1 comprising a vertical axes 12, a transverse axes 14, and a longitudinal axes 16. This axes system 10 is intended to aid in understanding of the disclosure herein, and is not intended to be limiting in any manner.

Figure 4:
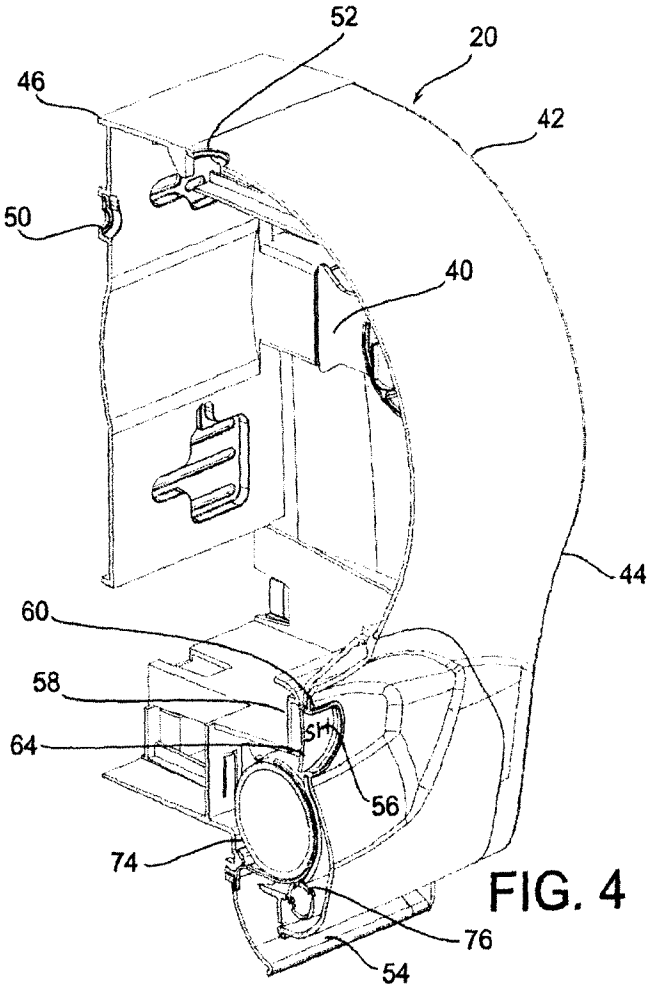
FIG. 4 is an isometric cutaway view of the hygienic dispenser shown in FIG. 3.
Figure 3:
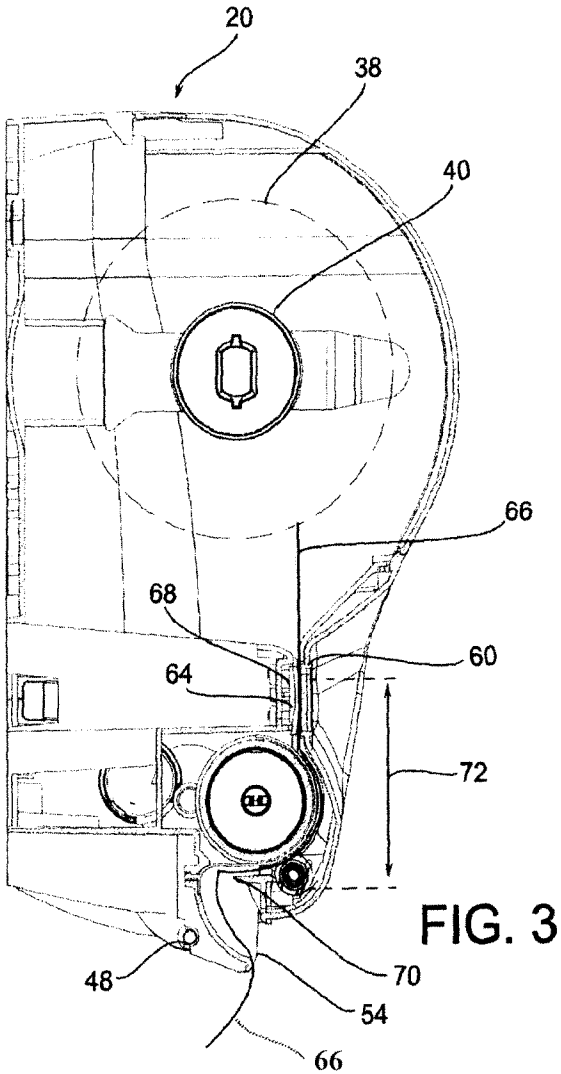
FIG. 3 is a side cutaway view of a hygienic dispenser according to one embodiment.

Referring to FIG. 3, one embodiment of the dispenser 20 is shown in a side cutaway view to assist in understanding the interior configuration of the dispenser 20. In one embodiment, a product roll 38, such as a roll of paper towel or toilet paper, is suspended upon a roll support 40 (which may be more easily seen in FIG. 5). Alternatively, the product roll 38 may simply rest on an inner portion of the casing or another component of the dispenser 20. Referring briefly to FIG. 4, the dispenser 20 is shown in an isometric cutaway view which more clearly shows the dispenser housing 42, which substantially comprises a front casing 44 coupled to a rear casing 46 at a casing pivot 48 (which is more easily shown in FIG. 3). The rear casing 46 is operatively configured to be attached to a vertical structure such as a bathroom wall by way of fasteners, such as screws, mounted through a plurality of mounting recesses 50. While the casing pivot 48 couples the rear casing 46 to the front casing 44 at the lowermost portion of the dispenser 20, a latching mechanism (not shown) may be provided in the upper region such as at a latching mechanism opening 52. The dispenser 20 also comprises a dispensing slot 54 at the bottom portion of the dispenser 20, through which the product 22 is dispensed, as shown in FIG. 2.

Figure 5:
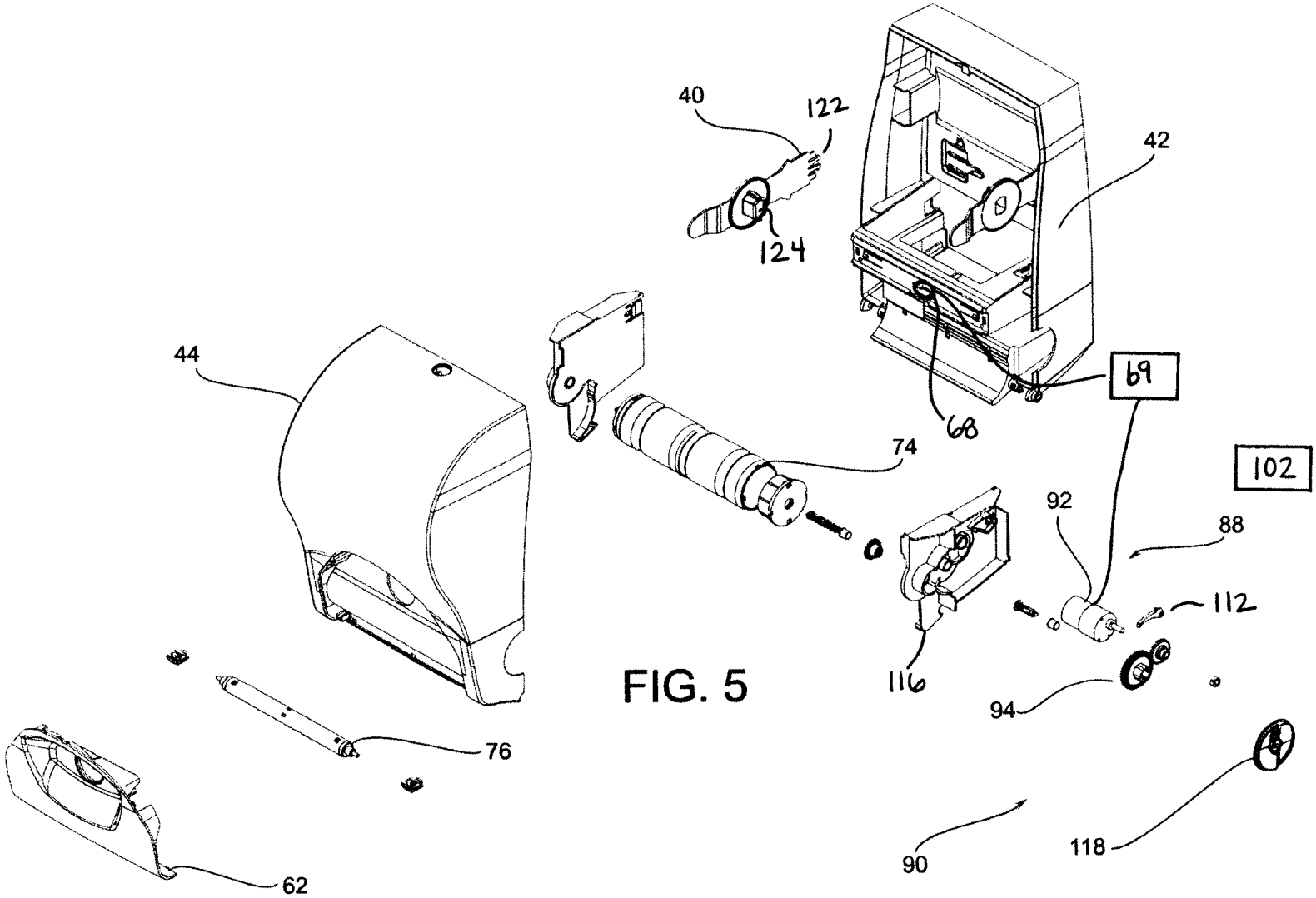
FIG. 5 is an isometric exploded view of the hygienic dispenser shown in FIG. 3.

Referring specifically at the lowermost front portion of the dispenser 20, as shown in FIG. 4, an engagement opening 56 is provided to allow a user access to the capacitive sensor 68. The engagement opening 56 is defined by an opening rim 60 around the engagement opening 56. The opening rim 60 may be provided in the front casing 44 as shown in FIGS. 1 and 2, or alternatively may be provided in a replaceable cover panel 62 as shown in FIG. 5. The capacitive sensor 68 comprises a contact surface 64, which in operation is behind the exposed portion 30 of the product 22, as previously described. In this arrangement, when the dispenser 20 detects a dispense request generally comprising an introduction of the user target 28 within an introduction threshold distance from the capacitive sensor 68 followed by a removal of the user target 28 beyond a removal threshold distance away from the capacitive sensor 68, the dispenser 20 is activated to dispense a portion of product 22 through the dispensing slot 54. Preferably, the portion of product 22 dispensed includes the exposed portion 30 that the user target 28 contacted through the engagement opening 56. Thus, a sanitary condition is constantly maintained.

Referring to FIG. 3, a product path 66 is shown, which is defined as the path the product 22 travels between the product roll 38 and the dispensing slot 54. As can be seen, the product path 66 passes between the opening rim 60 and the contact surface 64 of the capacitive sensor 68.

Thus, the exposed portion 30 of the product 22 provides a sanitary, constantly replaceable barrier between the user target 28 and the capacitive sensor 68. In one embodiment of operation, a cutting edge 70 is provided as shown in FIG. 3. The cutting edge 70 functions to allow the user to cut, or tear, the product 22 along a substantially straight or desired line. When a cutting edge 70 is utilized, the device comprises a minimum dispensed length 72 defined as the distance between the opening rim 60 and the cutting edge 70. In one particular example, the dispenser 22 comprises a minimum dispensed length 72 defined as the distance between the upper edge 73 of the opening rim 60 and the cutting edge 70. Of course, the dispensed length could be substantially longer than this, and may be adjustable by service personnel or could be pre-set as the dispenser 20 is built.

In one embodiment, seen in FIGS. 3-7, the product path 66 passes between a drive roller 74 and a pressure roller 76. The pressure roller 76 generally presses against the drive roller 74. In this way, when the drive roller 74 is caused to rotate, the product 22 will tend to be dispensed, as it is pressed against the drive roller 74 by the pressure roller 76. In one embodiment, the pressure roller 76 is coupled to the front casing 44. In this way, when the latching mechanism is released, and the front casing 44 pivots about the front casing pivot 48, the distance between the drive roller 74 and the pressure roller 76 will open up. Thus, when a replacement product roll 38 is inserted into the dispenser 20, it is much easier for the service personnel to direct the product 22 down the product path 66 and between the drive roller 74 and pressure roller 76. As the front casing 44 is rotated to a closed position, and the latching mechanism is reengaged, the product 22 is positioned along the product path 66 and is ready for dispensing.

Figure 6:
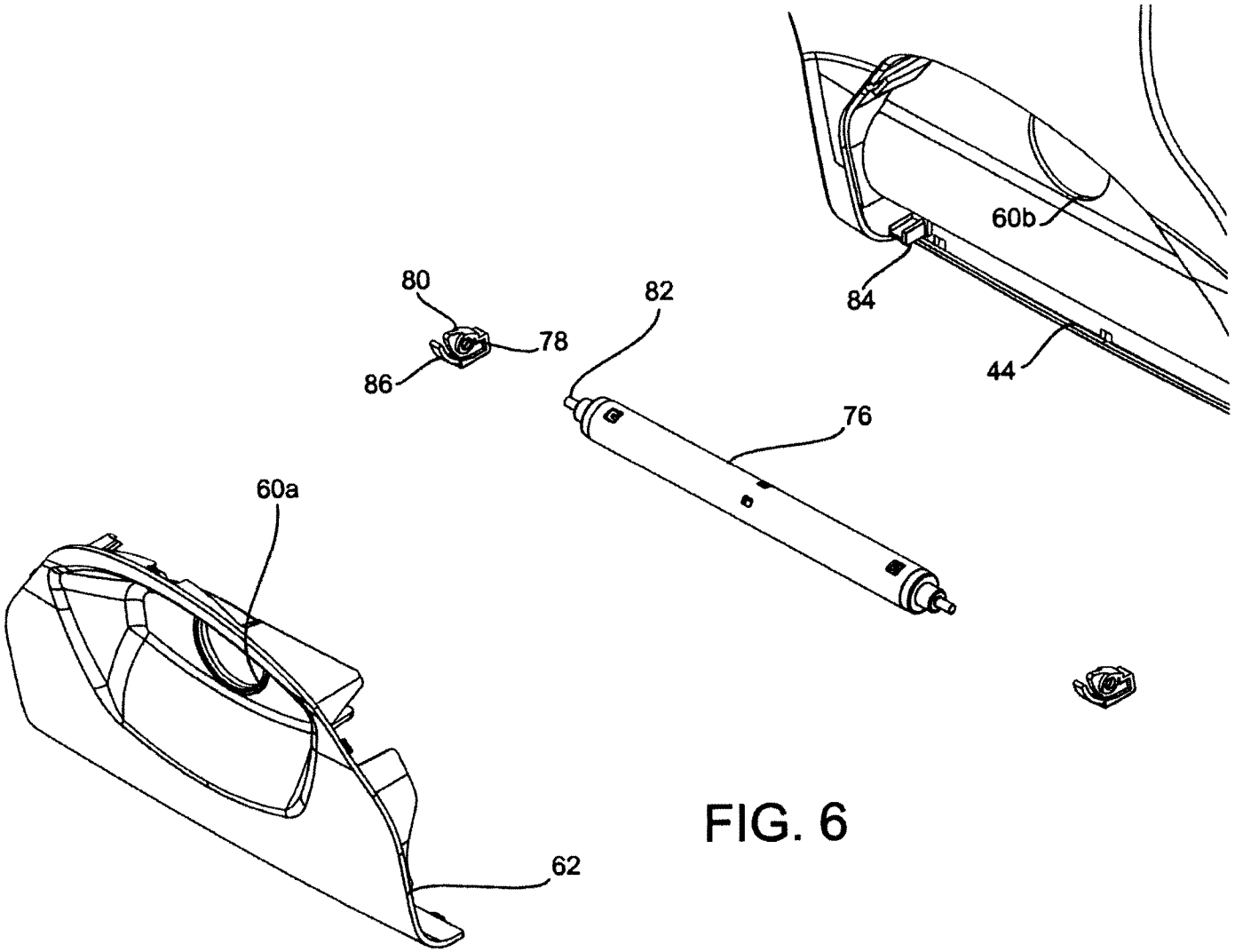
FIG. 6 is a detailed view of the hygienic dispenser shown in FIG. 3.

Referring to FIG. 5, the relationship of the pressure roller 76 to the cover panel 62 and front casing 44 can be seen. Referring to FIG. 6, which is a detail view of this portion of FIG. 5, it can be seen how in one embodiment, the pressure roller 76 is inserted into a bearing surface 78 of a spring clip 80. The spring clip 80 allows the pressure roller 76 to rotate about an axel end 82. In one embodiment, the spring clip 80 is press fit within a receiver 84, which is coupled to the front casing 44. Furthermore, the spring clip 80 comprises a spring arm 86 which functions to pressure or force the pressure roller 76 against the drive roller 74. In one embodiment, the cover panel 62 hides the pressure roller 76 and spring clip 80 from the view of the user 28. It can also be seen that the opening rim 60, as previously described and shown in FIG. 4, may comprise an opening rim **60*a* in the cover panel 62, and another opening rim 60*b* in the front casing 44. As previously described, this opening rim 60 allows the user access to the button mechanism 68 through the exposed portion 30 of the product 22**.

Referring back to FIG. 5, a powered advance assembly 88 and manual advance assembly 90 are shown. The powered advance assembly 88 generally comprises the drive roller 74 previously discussed, and a drive motor 92. In addition, a plurality of reduction gears 94 may be utilized to couple the drive motor 92 to the drive roller 74. In one embodiment, a pawl 112 is provided which may couple to a side frame 116 at a pawl receiver. The pawl 112 prohibits the drive roller 74 from rotating backwards, which would tend to draw the product 22 back up toward the product roll 38 along the product path 66. This may in some forms make it very difficult for the user to reengage the device, as most users will not have access to the interior portion of the dispenser 20.

A manual advance assembly 90 may also be incorporated as shown in FIG. 5. Manual advance assemblies are often utilized, as it is not uncommon for the powered advance assembly 88 to become non-functional, such as when the drive motor 92 no longer functions, or when the power source of the dispenser 22 no longer functions, such as when batteries are depleted. The manual advance assembly generally comprises a manual advance driver 118, which is exposed through the dispenser housing 42 such that a user 28 can manually engage the manual advance driver 118. As shown, the manual advance driver 118 comprises a disc-like wheel which is configured to substantially prohibit a user from rotating the manual advance driver 118 in a non-desired direction. These drivers 118 are well-known in the art, and also comprise pushbuttons, cranks, spurred wheels, and equivalents. In one embodiment, the manual advance driver 118 is coupled in such a way that when it is rotated, the drive motor 92 is not rotated, to increase ease in use. Such one-way drive mechanisms and one-way bearings are well-known in the art.

Also referring at FIG. 5, it can be seen how in one embodiment, each of the roll supports 40 are removably attached to the rear casing 46 at a support receiver 120. In one embodiment, a snap lock-type mechanism 122 is utilized to maintain the roll support within the support receiver 120. Additionally, a projection 124 can be utilized as an axle to engage the inner surface of the product roll 38.

Figure 7:
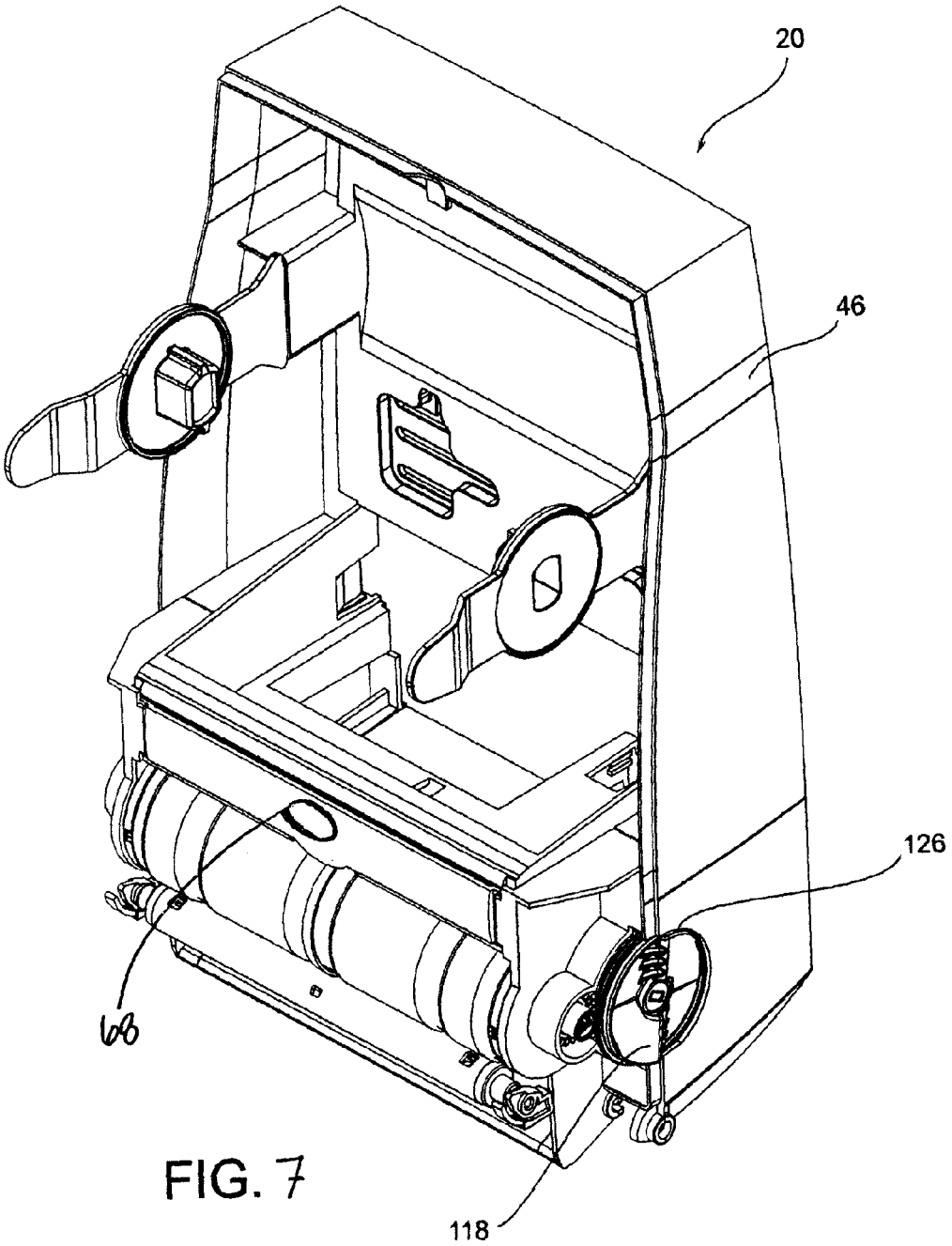
FIG. 7 is an isometric view of the hygienic dispenser shown in FIG. 3 with the front cover removed.

Referring now to FIG. 7, the dispenser 20 is shown with the front casing 44 removed to show the workings of the mechanism. As shown, the manual advance driver 118 extends through a casing opening 126 such that it can be reached and operated by a user. As the advance driver in one embodiment is recessed into the side of the dispenser, it will be more obvious to the user to utilize the capacitive sensor 68 in the front of the dispenser 22. Additionally, as the capacitive 68 will not be visible to a user, as it will be behind the exposed portion 30 of the product 22, there will likely be indications on the front casing 44, such as on the cover panel 62, to direct a user to direct a user target 28 towards the opening rim 60 to be detected by the capacitive sensor 68.

Figure 8:
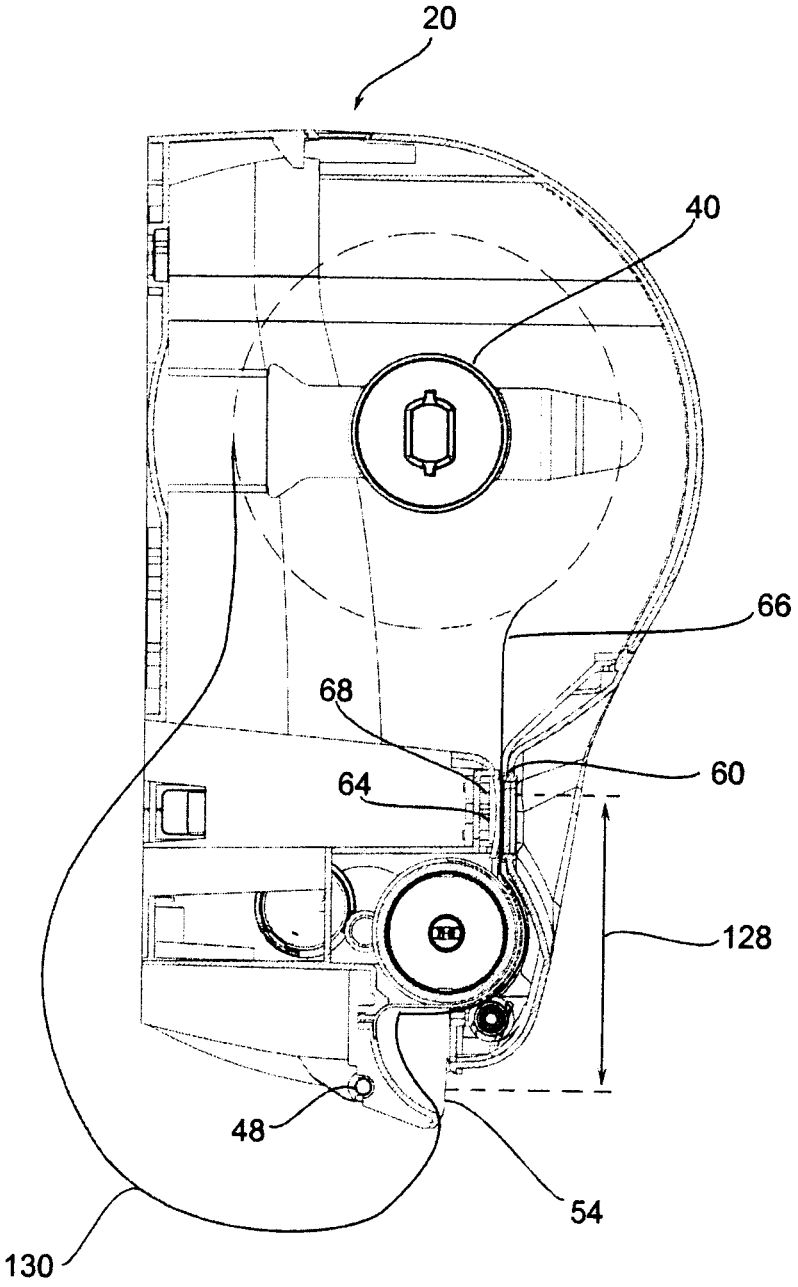
FIG. 8 is a side cutaway view of a hygienic dispenser using an "endless" roll of product according to one embodiment.

Referring to FIG. 8, another embodiment is shown where the minimum dispersed length 128 is defined as the length between the opening rim 60, and the dispensing slot 54. This embodiment may be utilized where the dispensed portion is not torn off by the user, but rather is cut by other methods, such as a cutter mounted on the drive roller, or pre-cut towels. This embodiment may also be utilized such that the product 22 is not removed at all, but rather comprises a return path 130 back into the dispenser 20, such as would be utilized in a continuous, cloth-type towel.

Referring back to FIG. 5, the dispenser 22 comprises a power source 102 and a controller 69 in communication with the capacitive sensor 68 and the drive motor 92. The power source 102 functions to provide electrical power to the capacitive sensor 68, the drive motor 92 and the controller 69. The power source 102 may comprise a battery, series of batteries, power supply, power adapter or other source of electrical power. In one embodiment, the power source 102 is coupled to a standard household power source, such as a 110V AC circuit commonly found in US structures.

The capacitive sensor 68 is configured to provide a detection signal to the controller 69 indicative of the proximity of the user target 28 to the capacitive sensor 68. The controller 69 is configured to identify a dispense request from a user based upon the detection signal received from the capacitive sensor 68 and activate the drive motor 92 upon the identification of a dispense request. The controller 69 may be any device capable of receiving a detection signal from the capacitive sensor 68, identifying a dispense request and activating the drive motor 92, such as, an electronic circuit, central processing unit, microprocessor, microcontroller, field programmable gate array, programmable logic controller, or other processing device.

As discussed above, prior art "touchless" dispensers have proven to be problematic in their response to different individuals and their performance in noisy environments. In many cases, such dispensers are susceptible to false triggers resulting in the unnecessary dispensing of product.

In one embodiment, the reliability of detecting valid dispense requests for product from the dispenser 22 is improved by requiring the presentation of a user target 28 to the dispenser 22 to satisfy a predetermined dispense request profile before a valid dispense request is identified. A valid dispense request is defined as an introduction of the user target 28 within an introduction threshold distance from the capacitive sensor 68 followed by a removal of the user target 28 beyond a removal threshold distance away from the capacitive sensor 68. The dispense request profile is a predetermined profile that defines one or more characteristics indicative of the introduction of the user target 28 within the introduction threshold distance from the capacitive sensor 68 followed by the removal of the user target 38 beyond the removal threshold distance away from the capacitive sensor 68. This unique profile assists in reducing the potential for false triggers.

The introduction threshold distance may be selected at any desirable distance from the capacitive sensor 68. Preferably the introduction threshold distance is selected to be in close proximity to the capacitive sensor 68 such that a large change in the detection signal received from the capacitance sensor 68 is provided before a valid introduction of a user target 28 is identified, thus, reducing the potential for false triggers. In one embodiment, the introduction threshold distance is selected to be approximately the distance between the exposed portion 30 of product 22 accessible through the engagement opening 28 and the capacitive sensor 68. Thus, in such embodiment, the user target 28 must touch (or almost touch) the exposed portion 30 of product 22 before an introduction of the user target 28 will be recognized. In another embodiment, the introduction threshold distance is selected to be approximately at the contact surface 64 of the capacitive sensor 68. Thus, in such embodiment, the user target 28 must touch (or almost touch) the contact surface 64 (or push the exposed portion 30 of product 22 against the contact surface 64) before an introduction of the user target 28 will be recognized.

The removal threshold distance may be selected at any desirable distance from the capacitive sensor 68. In the present embodiment, the removal threshold distance is approximately 5 mm.

In addition to reducing the potential for false triggers, the dispense request profile (requiring the removal of the user target 28 away from the capacitive sensor prior to identifying a dispense request and activating the drive motor 92) also assists in reducing the potential for product jams and related problems that may be caused by the user target 28 contacting the exposed portion 30 of the product 22 through the engagement opening 24 while the drive motor 92 is activated.

The controller 69 may also be configured to detect stop requests initiated by the user target 28. A stop request is defined as an introduction of the user target 28 within a stop threshold distance from the capacitive sensor 68 while the driver motor 92 is activated. The stop request may be identified based upon a comparison of the detection signal received from the capacitive sensor 68 to a stop request profile defining one or more characteristics indicative of the introduction of the user target 28 within the stop threshold distance from the capacitive sensor 68. Similar to the dispense request profile, the stop request profile assists in reducing the potential for product jams and related problems that may be caused by the user target 28 contacting a exposed portion 30 of the product 22 through the engagement opening 24 while the drive motor 92 is activated.

In typical prior art dispensers, the detection of the rotation of the drive roller and the detection of a user target are performed by separate sensors or actuators. In one embodiment provided herein, a single capacitive sensor 68 is utilized to detect both the rotation of the drive roller 74 and the user target 28. By using a single sensor, the number of components required to construct the dispenser 22 is reduced, thus, providing the opportunity for substantial cost savings.

Figure 9:
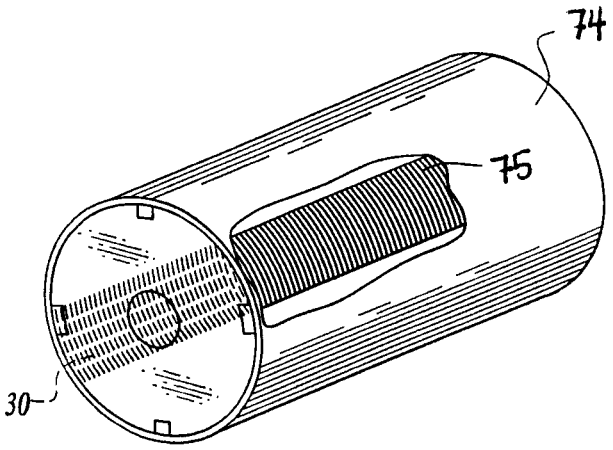
FIG. 9 is an exploded, diagrammatic view illustrating drum targets located on a drive roller and selected structural elements relating to the sensing of capacitance changes caused by the rotating drive roller according to one embodiment.

Referring to FIG. 9, in one embodiment, the drive roller 74 has a pair of drum targets 75 operatively associated therewith and movable responsive to rotation of the drive roller 74 by the drive motor 92. More particularly, in the arrangement illustrated, drive roller 74 has a pair of drum targets 75 in the form of strips extending along the length thereof and in diametric opposition to one another. The drum targets 75 are formed of any suitable metallic material and may be solid metal or adhesive foil for example, the material preferably being strongly dielectric. Any suitable material may be utilized for the drum targets 75 without departing as long as it is capable of being detected by the capacitive sensor 68 during rotation of the drive roller 74.

Figure 10:
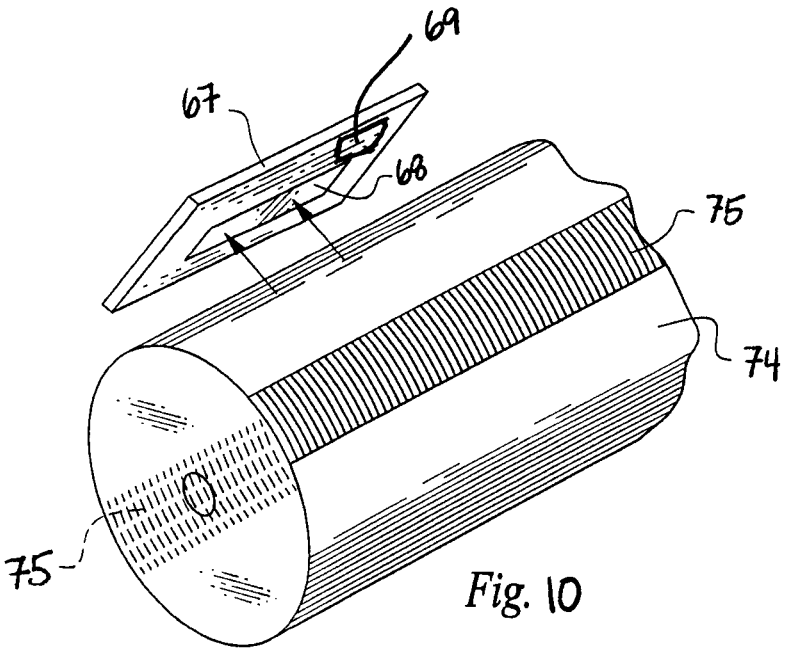
FIG. 10 is a diagrammatic view of a drive roller, drum targets and a capacitive sensor according to one embodiment.

The drum targets 75 may suitably be covered, as shown in FIG. 9, by a material such as over molded rubber. Such material may provide a good slip free surface for the product 22, as well as serve the purpose of maintaining the drum targets 75 in place. FIG. 10 illustrates the drum targets 75 being uncovered, which also may be suitable.

The capacitive sensor 68 is located adjacent to both the engagement opening 24 and the drive roller 74, and is configured to provide a detection signal indicative of both the proximity of the user target 28 and the drum targets 75 to the capacitive sensor 68. The controller 69 is configured to identify and distinguish dispense requests and drum target events based upon the detection signal received from the capacitive sensor 68. Drum target events are defined as the presence of a drum target 75 at one or more drum threshold distances from the capacitive sensor 68. For example, the drum threshold distances may be defined as where the presence of drum targets 75 in proximity to the capacitive sensor 68 results in periodic maximum and/or minimum detection signals provided by the capacitive sensor 68.

By inserting drum targets 75 into the drum roller 74, the capacitive sensor 68 is able to detect both the drum targets 75 and the spaces between them as a rotational count, providing a window of four counts (two targets and two spaces). As will be described in greater detail below, the controller 69 is configured to detect the "on/off" patterns produced by the capacitive sensor 68 detecting the drum targets 75 rotating with the drive roller 74, thereby permitting the controller 69 to determine the angular position of the drive roller 74 and total angular distance that it has rotated in the current dispensing cycle. Based upon this information, the controller 69 may determine and control the total length of product 22 dispensed from the dispenser 22. In addition, the controller 69 may detect any jams of the product 22 if a subsequent drum target event is not detected within a predetermined period of time.

Figure 11:
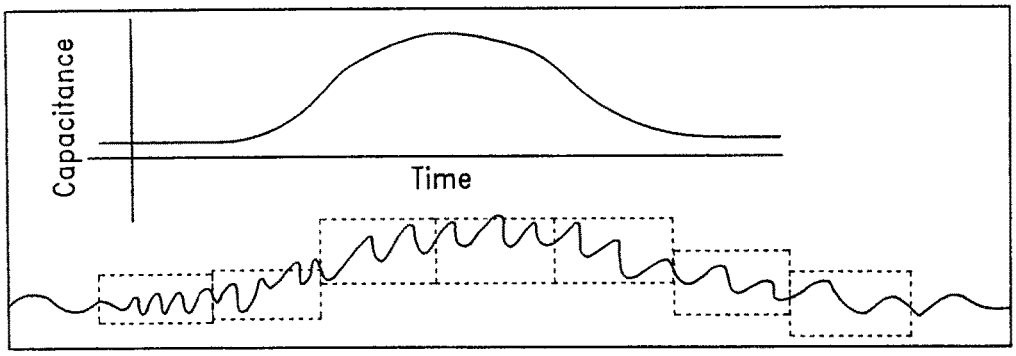
Fig. 11 (Prior Art)
FIG. 11 is a capacitance/time diagram illustrating the principles of operation of a conventional prior art detection approach.

As discussed above, traditional approaches to using capacitance sensing for detecting moving and/or rotating or objects have posed challenges. Referring to FIG. 11, a brief explanation of one traditional approach that is commonly practiced for both analog and digital detection is presented. Each box depicted by dash lines in FIG. 11 represents a counting window, during which peaks in a detection signal provided by a capacitive sensor are counted and used as a proxy for the sensor's oscillation frequency. The length of the window is determined by the running frequency of a processing device and a programmable internal timer.

Figure 12:
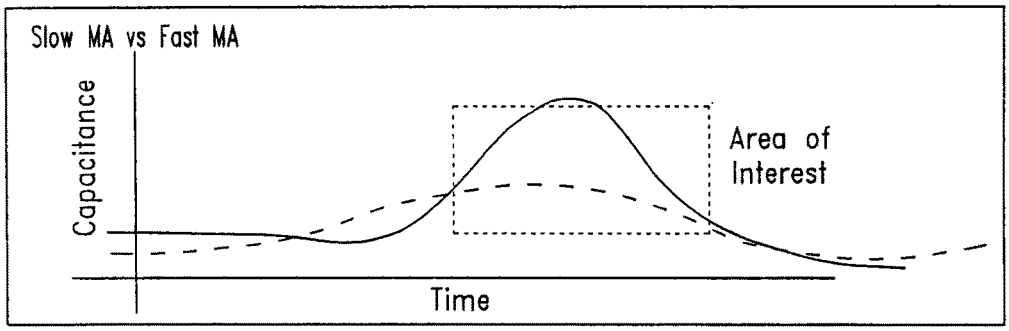
Fig. 12 (Prior Art)
FIG. 12 illustrates a traditional prior art approach of dealing with capacitance sensed signals.

The capacitance sensor forms what is essentially an antenna, and the oscillations of the detection signal provided by the sensor will not produce a single, stable frequency, but rather a noisy series of readings. One method for reducing the effect of the noise is to smooth out the signal (e.g. low-pass filter or average). This may be done with RC-type circuits in the analog domain or through signal processing in the digital domain. The smoothed out signal is depicted in FIG. 11 in a capacitance/time graph. Multiple averages or different time-lengths may also be used. This is typically done by looking at times when an average of shorter time length crosses over or under an average of longer time length, as shown in FIG. 12.

These methods have drawbacks for detecting short-duration events such as a hand wave. For example, the FIG. 12 approach requires storage of two additional streams of numbers (one for each average); it is difficult to determine the "best" time lengths for averaging, as it changes with changes in ambient noise levels; and undesirable latency between when an event happens and when it is detected can be introduced.

Figure 18:
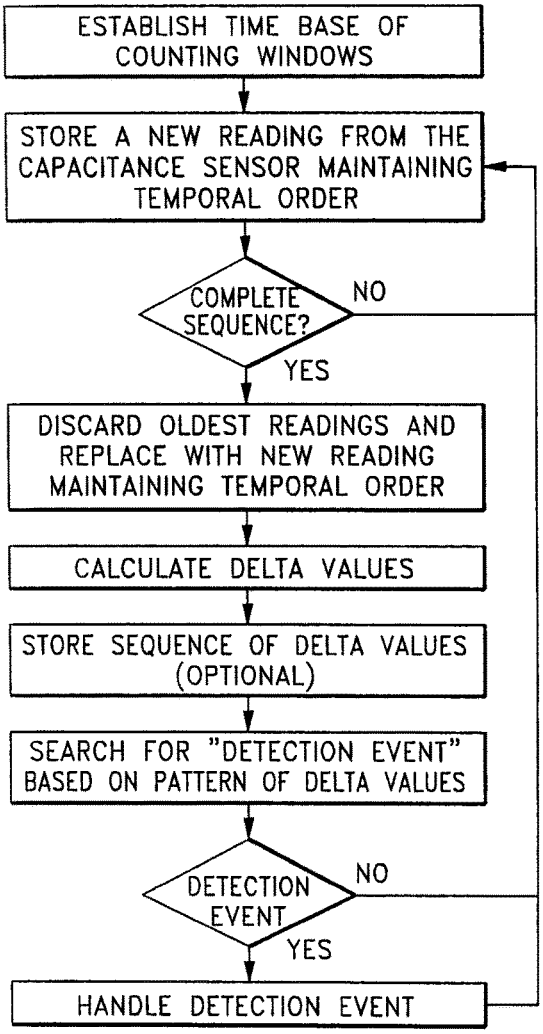
FIG. 18 is a block diagram showing sequential steps carried out when practicing the delta method according to one embodiment.

The present disclosure presents an alternative method for identifying events in a detection signal provided by a capacitive sensor referred to herein as the "delta method". One embodiment of the delta method is described with reference to FIG. 18.

Figure 13:
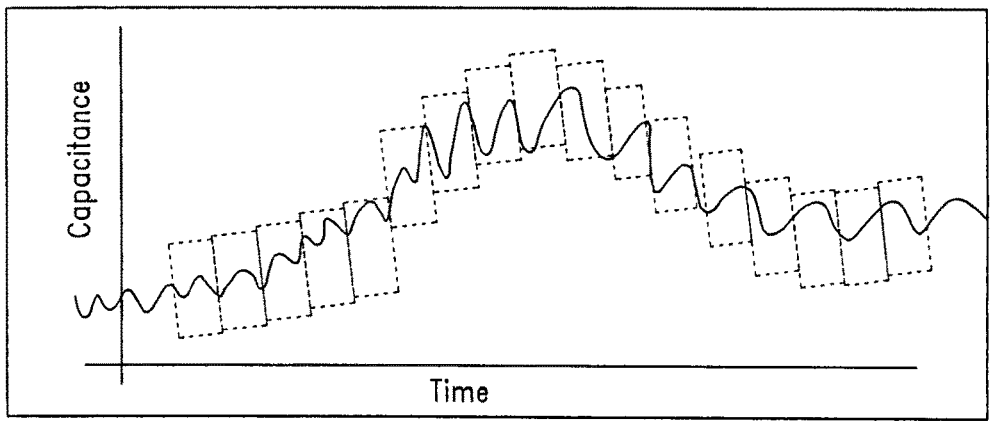

Utilizing the delta method, the starting point for processing data is the counting window. FIG. 13 shows relatively short counting windows applied to a single processing stream. The sequence of readings is stored, in a memory that is accessible by the controller 69. No averages need be computed, although the method will also work with both averaged and filtered readings. For example, well known techniques such as pre-filtering detection signals to eliminate 60 Hz noise are compatible with the proposed method. The method looks at the difference between readings taken from the detection signal at different points in time. These points in time may in fact be consecutive readings, or they may be separated by a set or arbitrary length of time, as depicted in FIG. 14.

Using this collected raw data, the processing then proceeds as follows. The difference or the "delta" between counting windows is calculated and stored in an array of delta values. The length of the array is a function of the type of event detected and the noise signal. If the raw frequency were to be plotted, this array of delta values could be considered a proxy for the second derivative of the raw frequency curve of the detection signal. A detection event now becomes a specific pattern in this second derivative.

One example of what the algorithm will search for, while maintaining an array of delta values of suitable length, or an array of readings upon which delta computations are performed at each time interval, is a pattern similar to a square wave pulse, such as depicted in FIG. 15. The pattern has a relatively flat "low" level, a sharp or "fast" rise from that "low" level, a short period of relative flatness at a "high" or elevated level, and a sharp drop from the elevated region. While this example illustrates a possible sequence of operations for a hand detection, many other types of events can be detected by changing the specific pattern being searched for. In a linear representation, this pattern match will look similar to that shown in FIG. 16 wherein an "X" denotes a "don't care" value, and the other entries specify a range of acceptable values for that location in the array of delta values. A detection event then becomes a ratio of matching vs. non-matching values across the array of deltas values. The comparison values may be stored as an explicit sequence of values, or stored implicitly as a part of the mathematical function that performs event detection.

In some applications, one delta calculation may be insufficient to establish a detection event. The delta method can be extended to use multiple samples, across arbitrary lengths of time, as illustrated in FIG. 17.

FIG. 17 exemplifies an implementation where the delta method has a look-back time of four samples and requires a specific relationship between two sets of delta calculations. In this case, the reading at time (Y+1) is compared to the reading at time (X+1), and the reading at time (X) is compared to the reading at time (Y). The two comparisons may look for the same threshold, or they may be independent tests. For example, for a very sharp change in the signal, the comparison between X and Y may look for a small change and a large change between (X+1) or (Y+1). Alternatively, a small change in a noisy environment may look for a moderate, identical change in both comparisons. Multiple windows can also be used when storage space is limited, as more windows allow storage of smaller amounts of data.

Figure 20:
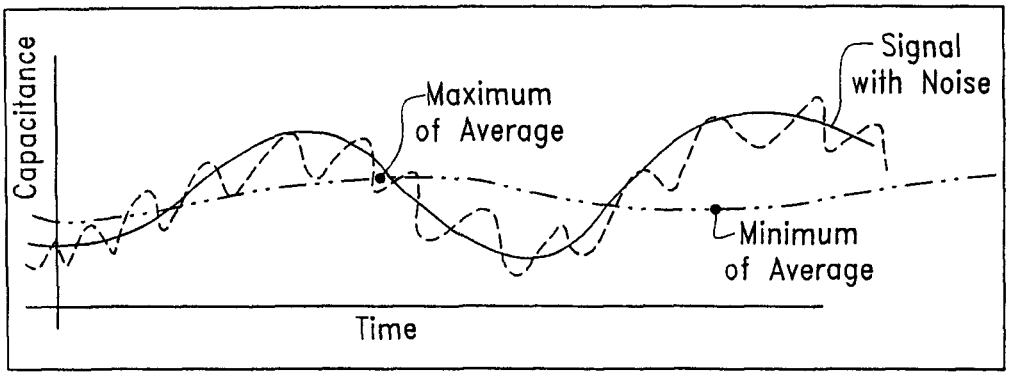
Fig. 20 (Prior Art)
FIG. 20 illustrates a traditional prior art approach of dealing with capacitance sensed signals by smoothing or averaging them.

The delta method can also be effectively used to track the movement of a drive roller. One traditional approach to dealing with capacitance sensed signals for rotating or periodic objects is to smooth out or average them as shown in the capacitance/time graph or diagram of FIG. 20. The solid line is the base line with the noise superimposed depicted by a dash line. The dot-line is the smooth average.

The detection signal generated for rotating or periodic objects should generally be expressed as sine wave or other essentially periodic waveform of a relatively stable frequency. To detect a specific point on a drive roller passing near a capacitive sensor, it is only necessary to search for a peak value. However, in noisy environments it is possible that the peak value with negative noise won't meet the value necessary to trigger a detection event. Or, a value with positive noise far from a peak event may be sufficient to trigger a false detection. For this reason, an improved approach to detecting the rotation of a drive roller is to apply the delta method.

Figure 21:
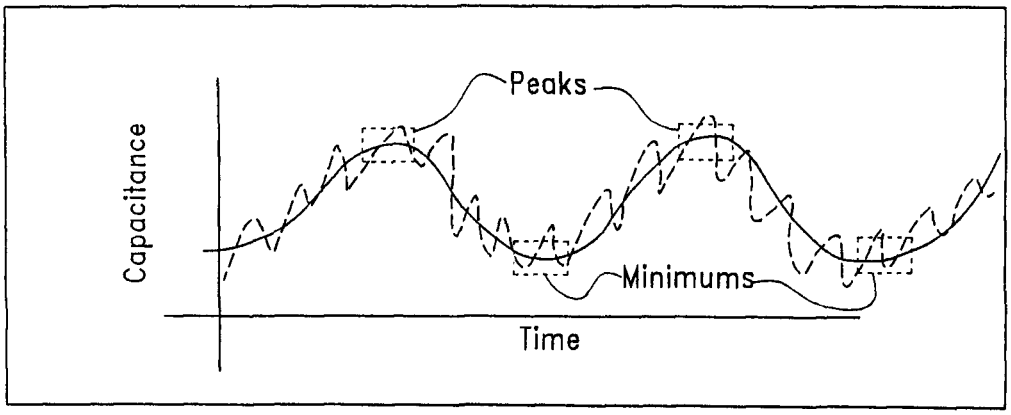
FIGS. 21 and 22 are capacitance/time diagrams illustrating approaches relating to the utilization of the delta method to sense capacitance changes according to one embodiment.

Referring to FIG. 21, the look-back distance between samples is a function of the sampling rate and the rotational speed of the drive roller 74. The counting window is small, to allow for multiple counts across the general maximum and minimum parts of the expected curve provided in the detection signal from the capacitive sensor 68. For random noise, this significantly increases the probability of detecting a peak while reducing the chance of a false positive. This is because a threshold value closer to the theoretical maximum distance between peaks and minimums can be used.

Figure 22:
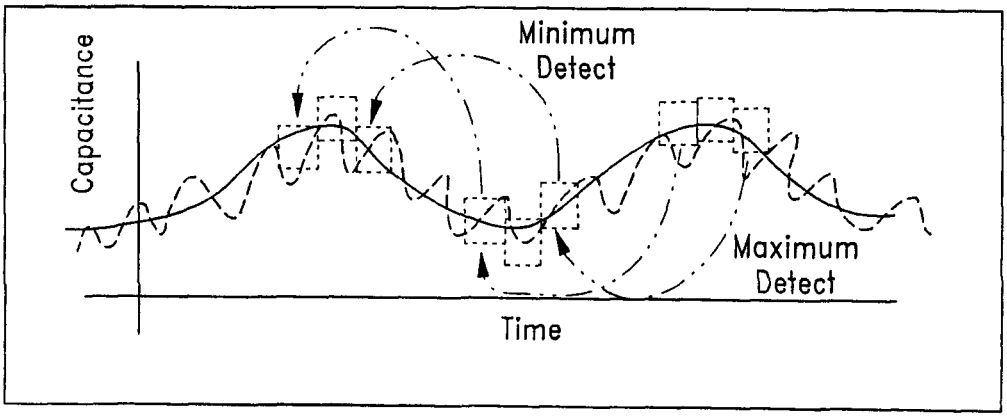

Two further variations or embodiments are proposed to deal with particularly challenging sensing environments as shown in FIG. 22. The first variation uses multiple simultaneous deltas. This can be achieved in several ways, the simplest being to perform multiple comparisons at each point in time. With multiple comparisons, a detection event can be treated as a more complex "voting" scheme—e.g., two out of three delta compares meet a threshold.

Referring to FIG. 22, a second variation to detect both maximum and minimum values in the signal generated by the rotating object is shown. This embodiment of the delta method alternates between searching for peaks and valleys. The operations can be considered inverse to each other: a peak may look for values above a high threshold; a valley may look for values below a low or negative threshold. This is advantageous as it doubles the resolution at which the drive roller 74 can be controlled, which allows for finer control of the quantity being dispensed by the drive roller 74. The cost implications are obvious.

There may be implementations wherein a rotating roller spun by an electric motor, cannot maintain a constant rotational speed or cadence. An example of how this can occur is in the case of a battery-powered motor, the batteries having been significantly depleted, cause a slowing rotation of the roller. In the case of a paper dispenser where the paper is stored on a large roll, the rotational speed may be different between a full roll (heavy) and a nearly depleted roll (light). A further example is the possible effect of friction of the mechanical structure changing as the dispenser is used over time.

Figure 19:
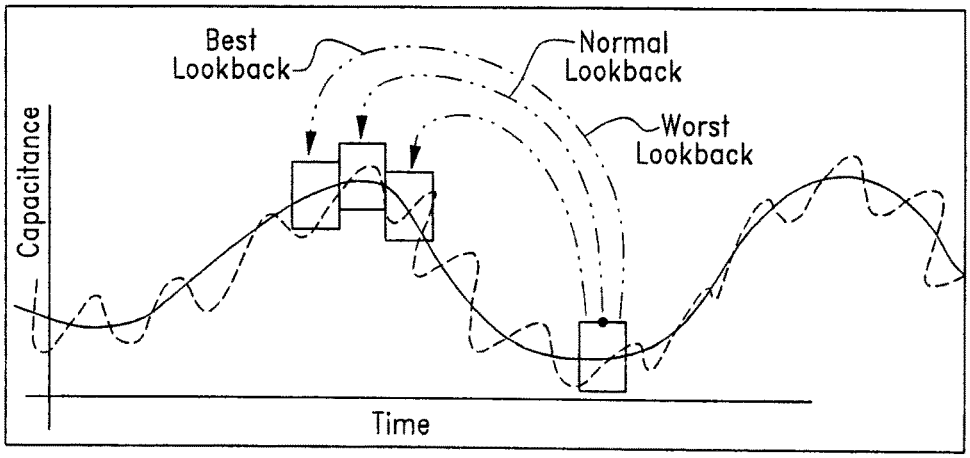
FIG. 19 is a capacitance/time diagram illustrating an approach relating to the utilization of the delta method to sense capacitance changes according to one embodiment.

The delta method allows an approach for dealing with these variations in rotational speed. As shown in FIG. 19, the look-back distance for the delta calculation can be variable. The variation of this look-back method distance is a function of the particular embodiment; for example, the look-back distance can be a function of the measured voltage at the battery terminals. Or the mechanical changes over time can be characterized, and the look-back distance can be calculated using an algorithm that understands the "aging" of the frictional resistance of the mechanical system.

Figure 23:
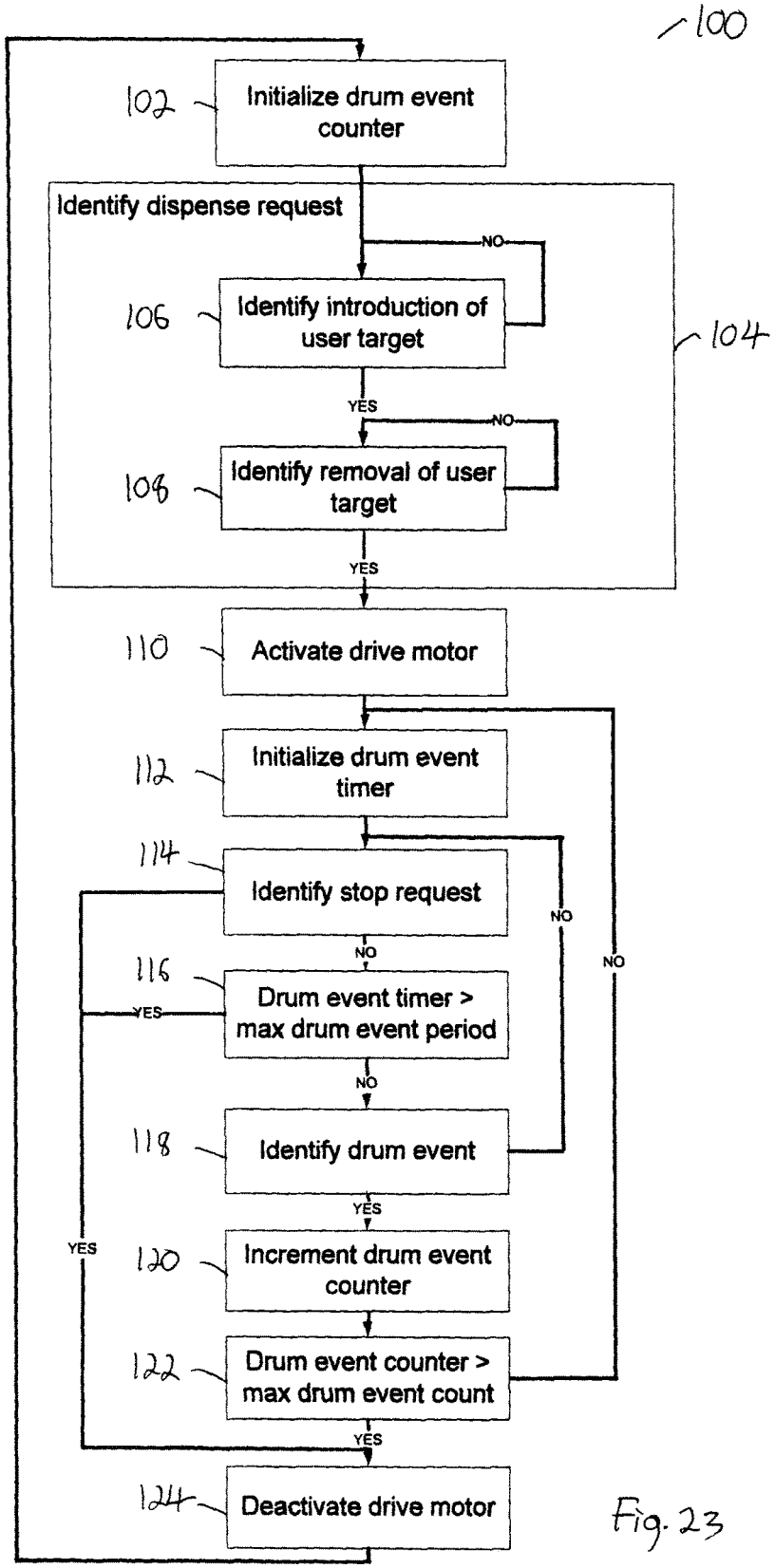
FIG. 23 is a flow diagram of a method of operation of the dispenser shown in FIG. 1 according to one embodiment.

Referring to FIG. 23, a flow diagram 100 of a method of operation of one embodiment of the dispenser 22 is shown. The method starts in block 102 where the controller 69 initializes a drum event counter to zero. The drum event counter is used to count the number of drum events identified by the controller 69 once the drive motor 92 is activated.

The method then proceeds to block 104 where the controller 69 continuously examines the detection signal from the capacitive sensor 68 to identify a dispense request. In block 106, the controller 69 repetitively applies the delta method to the detection signal until an introduction of the user target 28 within an introduction threshold distance from the capacitive sensor 68 is identified. Once an introduction is identified, the method proceeds to block 108 where the controller 69 repetitively applies the delta method to the detection signal until a removal of the user target 28 beyond a removal threshold distance away from the capacitive sensor 68 is identified. Once the controller 69 has identified both the introduction and removal of the user target 28 a dispense request is considered to be identified.

Optionally, the method may provide a removal event timer which is started upon the detection of the introduction of the user target 28 within an introduction threshold distance from the capacitive sensor 68. If a removal of a removal of the user target 28 beyond a removal threshold distance away from the capacitive sensor 68 is not identified within a max removal period, it is assumed that the a dispense request is not desired (for example, the detected introduction was not actually a user target 28 but a change in the environment) and the method proceeds back to block 106 and awaits an introduction of a user target 28.

Once a dispense request is identified, the method then proceeds to block 110 where the controller 69 activates the drive motor 92 to rotate the drive roller 74 to begin dispensing product 22 from the dispenser 22. The method then proceeds to block 112 where the controller 69 restarts a drum event timer which is used to measure the time between drum events.

The method then proceeds to block 114 where the controller 69 applies the delta method to the detection signal to determine if a stop request has occurred. If a stop request is identified, the method proceeds to block 124 where the controller 69 deactivates the drive motor 92, otherwise, the method proceeds to block 116.

In block 116, the controller 69 compares the current value of the drum event timer to a max drum event period. If a drum event is not detected after the max drum period from a previous drum event, it is likely that a product jam or other related problem has occurred which is preventing the drive motor 92 and drive roller 74 from rotating. If the current value of the drum event timer exceeds the max drum period then there is likely a problem and the method proceeds to block 124 where the controller 69 deactivates the drive motor 92, otherwise, the method proceeds to block 118.

In block 118, the controller 69 applies the delta method to the detection signal to determine if a drum event has occurred. If a drum event is identified, the method proceeds to block 124, otherwise, the method returns to block 114. In block 120, the controller 69 increments the drum event counter to account for the new drum event identified in block 118.

The method then proceeds to block 122, where the controller compares the current value of the drum event counter to a max drum event count. The max drum count is used to specify the length of product 22 that is to be dispensed from the dispenser 22 in each regular dispensing cycle. If the current value of the drum event counter is greater than or equal to the max drum event counter, then a sufficient length of product 22 has been dispensed and the method proceeds to block 124 where the controller 69 deactivates the drive motor 92, otherwise, the method returns back to block 112.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept

The invention claimed is:

1. A hygienic product dispenser for dispensing a length of product from a product roll, the dispenser comprising:

a. a dispenser housing comprising a dispensing slot and an engagement opening;

b. a drive roller operatively configured to engage the product being dispensed;

c. a drive motor coupled to the drive roller;

d. a capacitive sensor adjacent to the engagement opening and operatively configured to provide a detection signal representing the proximity of a user target from the capacitive sensor;

e. a product path defined as the path the product will take from the product roll to the dispensing slot, the product path passing between the engagement opening and the capacitive sensor; and f. a controller in communication with the capacitive sensor and the drive motor, the controller operatively configured to identify a dispense request based upon the detection signal received from the capacitive sensor and activate the drive motor upon the identification of the dispense request, the dispense request defined as an introduction of the user target within an introduction threshold distance from the capacitive sensor followed by a removal of the user target beyond a removal threshold distance away from the capacitive sensor, wherein the dispense request is identified based upon a comparison of the detection signal received from the capacitive sensor to a dispense request profile, the dispense request profile defining one or more characteristics indicative of the introduction of the user target within the introduction threshold distance from the capacitive sensor followed by the removal of the user target beyond the removal threshold distance away from the capacitive sensor, and wherein the comparison of the detection signal received from the capacitive sensor to the dispense request profile comprises:

a. establishing a plurality of time period based dispense request counting windows, each dispense request counting window encompassing a selected portion of the detection signal differing from selected portions of the detection signal encompassed by other dispense request counting windows;

b. calculating delta values between selected dispense request counting windows to provide an array of delta values; and c. comparing the dispense request profile to the array of delta values.

2. The product dispenser according to claim 1, wherein the dispense request profile approximates a positive square wave pulse representing the introduction of the user target within the introduction threshold distance to the capacitive sensor followed by a negative square wave pulse representing the removal of the user target beyond the removal threshold distance away from the capacitive sensor.

3. The product dispenser according to claim 1, wherein the dispense request is defined as the introduction of the user target in contact with a portion of the product passing between the engagement opening and the capacitive sensor followed by the removal of the user target from contact with that portion of the product.

4. The product dispenser according to claim 1, wherein the controller is further operatively configured to:

a. identify a stop request based upon the state of the drive motor and the detection signal received from the capacitive sensor; and b. deactivate the drive motor upon the identification of the stop request, the stop request defined as an introduction of the user target within a stop threshold distance from the capacitive sensor while the driver motor is activated.

5. The product dispenser according to claim 4, wherein the stop request is identified based upon a comparison of the detection signal received from the capacitive sensor to a stop request profile, the stop request profile defining one or more characteristics indicative of the introduction of the user target within the stop threshold distance from the capacitive sensor.

6. The product dispenser according to claim 5, wherein the comparison of the detection signal received from the capacitive sensor to the stop request profile comprises:

a. establishing a plurality of time period based stop request counting windows, each stop request counting window encompassing a selected portion of the detection signal differing from selected portions of the detection signal encompassed by other stop request counting windows;

b. calculating delta values between selected stop request counting windows to provide an array of delta values; and c. comparing the stop request profile to the array of delta values.

7. The product dispenser according to claim 6, wherein the stop request profile approximates a positive square wave pulse representing the introduction of the user target within the stop threshold distance from the capacitive sensor.

8. The product dispenser according to claim 1, wherein:

a. the drive roller further comprises one or more drum targets;

b. the capacitive sensor comprises a single antenna adjacent to both the engagement opening and the drive roller; and c. the capacitive sensor is further operatively configured to provide a detection signal indicative of the proximity of the user target and the one or more drum targets to the capacitive sensor; and d. the controller is further operatively configured to identify and distinguish dispense requests and drum target events based upon the detection signal received from the capacitive sensor, the drum target events defined as the presence of the one or more drum targets at one or more drum threshold distances from the capacitive sensor.

9. The product dispenser according to claim 8, wherein:

a. the dispense request is identified based upon a comparison of the detection signal received from the capacitive sensor to a dispense request profile, the dispense request profile defining one or more characteristics indicative of the introduction of the user target within the introduction threshold distance from the capacitive sensor followed by the removal of the user target beyond the removal threshold distance away from the capacitive sensor; and b. the drum event is identified based upon a comparison of the detection signal received from the capacitive sensor to a drum event profile, the drum event profile defining one or more characteristics indicative of the presence of the one or more drum targets at one more drum threshold distances from the capacitive sensor.

10. The product dispenser according to claim 9, wherein:

a. the comparison of the detection signal received from the capacitive sensor to the dispense request profile comprises:

i. establishing a plurality of time period based dispense request counting windows, each dispense request counting window encompassing a selected portion of the detection signal differing from selected portions of the detection signal encompassed by other dispense request counting windows;

ii. calculating delta values between selected dispense request counting windows to provide an array of delta values; and iii. comparing the dispense request profile to the array of delta values; and b. the comparison of the detection signal received from the capacitive sensor to the drum event profile comprises:

i. establishing a plurality of time period based drum event counting windows, each drum event counting window encompassing a selected portion of the detection signal differing from selected portions of the detection signal encompassed by other drum event counting windows;

ii. calculating delta values between selected drum event counting windows to provide an array of delta values; and iii. comparing the drum event profile to the array of delta values.

11. The product dispenser according to claim 10, wherein:

a. the dispense request profile approximates a positive square wave pulse representing the introduction of the user target within the introduction threshold distance to the capacitive sensor followed by a negative square wave pulse representing the removal of the user target beyond the removal threshold distance away from the capacitive sensor; and b. the drum event profile comprises periodic alternating minimum and maximum values of the array of delta values.

12. A hygienic product dispenser for dispensing a length of product from a product roll, the dispenser comprising:

a. a dispenser housing comprising a dispensing slot and an engagement opening;

b. a drive roller operatively configured to engage the product being dispensed;

c. a drive motor coupled to the drive roller;

d. a capacitive sensor adjacent to the engagement opening and operatively configured to provide a detection signal representing the proximity of a user target from the capacitive sensor;

e. a product path defined as the path the product will take from the product roll to the dispensing slot, the product path passing between the engagement opening and the capacitive sensor; and f. a controller in communication with the capacitive sensor and the drive motor, the controller operatively configured to identify a dispense request based upon the detection signal received from the capacitive sensor and activate the drive motor upon the identification of the dispense request, the dispense request defined as an introduction of the user target within an introduction threshold distance from the capacitive sensor followed by a removal of the user target beyond a removal threshold distance away from the capacitive sensor, wherein the controller is further operatively configured to:

a. identify a stop request based upon the state of the drive motor and the detection signal received from the capacitive sensor; and b. deactivate the drive motor upon the identification of the stop request, the stop request defined as an introduction of the user target within a stop threshold distance from the capacitive sensor while the driver motor is activated.

13. The product dispenser according to claim 12, wherein the stop request is identified based upon a comparison of the detection signal received from the capacitive sensor to a stop request profile, the stop request profile defining one or more characteristics indicative of the introduction of the user target within the stop threshold distance from the capacitive sensor.

14. The product dispenser according to claim 13, wherein the comparison of the detection signal received from the capacitive sensor to the stop request profile comprises:

a. establishing a plurality of time period based stop request counting windows, each stop request counting window encompassing a selected portion of the detection signal differing from selected portions of the detection signal encompassed by other stop request counting windows;

b. calculating delta values between selected stop request counting windows to provide an array of delta values; and c. comparing the stop request profile to the array of delta values.

15. The product dispenser according to claim 14, wherein the stop request profile approximates a positive square wave pulse representing the introduction of the user target within the stop threshold distance from the capacitive sensor.

16. The product dispenser according to claim 12, wherein:

a. the drive roller further comprises one or more drum targets;

b. the capacitive sensor comprises a single antenna adjacent to both the engagement opening and the drive roller; and c. the capacitive sensor is further operatively configured to provide a detection signal indicative of the proximity of the user target and the one or more drum targets to the capacitive sensor; and d. the controller is further operatively configured to identify and distinguish dispense requests and drum target events based upon the detection signal received from the capacitive sensor, the drum target events defined as the presence of the one or more drum targets at one or more drum threshold distances from the capacitive sensor.

17. The product dispenser according to claim 16, wherein:

a. the dispense request is identified based upon a comparison of the detection signal received from the capacitive sensor to a dispense request profile, the dispense request profile defining one or more characteristics indicative of the introduction of the user target within the introduction threshold distance from the capacitive sensor followed by the removal of the user target beyond the removal threshold distance away from the capacitive sensor; and b. the drum event is identified based upon a comparison of the detection signal received from the capacitive sensor to a drum event profile, the drum event profile defining one or more characteristics indicative of the presence of the one or more drum targets at one more drum threshold distances from the capacitive sensor.

18. The product dispenser according to claim 17, wherein:

a. the comparison of the detection signal received from the capacitive sensor to the dispense request profile comprises:

i. establishing a plurality of time period based dispense request counting windows, each dispense request counting window encompassing a selected portion of the detection signal differing from selected portions of the detection signal encompassed by other dispense request counting windows;

ii. calculating delta values between selected dispense request counting windows to provide an array of delta values; and iii. comparing the dispense request profile to the array of delta values; and b. the comparison of the detection signal received from the capacitive sensor to the drum event profile comprises:

i. establishing a plurality of time period based drum event counting windows, each drum event counting window encompassing a selected portion of the detection signal differing from selected portions of the detection signal encompassed by other drum event counting windows;

ii. calculating delta values between selected drum event counting windows to provide an array of delta values; and iii. comparing the drum event profile to the array of delta values.

* * * * *